US005216868A

United States Patent [19]

Cooper et al.

[11] Patent Number: 5,216,868

[45] Date of Patent: Jun. 8, 1993

[54] PACKAGING PRODUCT AND MACHINE FOR MAKING SAME

[75] Inventors: Andrew K. Cooper, 7931 Deering Ave., Canoga Park, Calif. 91304; Roger E. Musser, Chatsworth, Calif.

[73] Assignee: Andrew K. Cooper, Canoga Park, Calif.

[21] Appl. No.: 826,850

[22] Filed: Jan. 28, 1992

[51] Int. Cl.[5] ..... B65B 61/00

[52] U.S. Cl. ..... 53/79; 53/472

[58] Field of Search ..... 53/92, 472, 403, 511, 53/510, 433, 432; 493/967, 904

[56] References Cited

U.S. PATENT DOCUMENTS 3,389,534 6/1968 Pendleton ..... 53/79 X
3,575,757 4/1971 Smith ..... 53/79 X
3,667,593 6/1972 Pendleton ..... 53/472 X
3,817,803 6/1974 Horsky ..... 53/79 X
3,938,298 2/1976 Luhman et al. ..... 53/79 X

*Primary Examiner*—James F. Coan
*Attorney, Agent, or Firm*—Roger A. Marrs

[57] ABSTRACT

A packaging product is disclosed herein having an elongated strip composed of a plurality of inflated cells joined by a separable perforated section so that the cells are available in an in-line or series relationship suitable for selective separation by the user after production and dispensing from a machine having a strip transport for passing the strip by processing stations for sealing, inflation and perforation to provide separable slots for selective detection.

1 Claim, 1 Drawing Sheet

PACKAGING PRODUCT AND MACHINE FOR MAKING SAME

BACKGROUND OF THE INVENTION

1. Field of the Invention

The present invention relates to the field of packaging materials, and more particularly to a novel package material having shock-absorbing capabilities and a machine for making such packaging material whereby the user may readily dispense a quantity of such material from a machine which fabricates the material in the form of inflated cells detachably connected together.

2. Brief Description of the Prior Art

In the past, it has been the conventional practice to provide a packaging material composed of small masses of foam composition, such as composed from polystyrene or polyethylene. Such packaging material is used as stuffers in a compartment so as to protect fragile products when transported from one place to another either by commercial or government handling authorities. Such plastic-like pieces of foam are sometimes referred to as "peanuts" because of their peanut-like shape, and in other instances, the foam composition is of irregular form or of special form conformal to the article being transported in the carton. In the instance of "peanuts", such foam composition is purchased in large bags which are kept in inventory at the site of shipment until ready for usage. This represents a relatively uneconomical means for such packaging material since it requires space for storage and must be purchased before usage from outside sources. In some instances, problems have been encountered by the receiver of packages containing such conventional foam material which stem from disposal problems since some plastic foam compositions are not acceptable for recycling procedures.

Another prior packaging material takes the form of a unitary sheet having a multiplicity of integrally formed bubbles that are connected together on the sheet and not separable. Such sheets are manufactured off-site from their location of use and are generally stored in rolls at the location of use after purchase and supply by the manufacturer. Also, the user must either fold the sheet to fit the article to be shipped, or specifically cut the sheet to accommodate the package.

Therefore, a long-standing need has existed to provide a novel packaging material which need not be stored in inventory at the point of shipment, but which may be fabricated by the user at the time that such material is needed and which will not only readily protects the object being shipped in the carton or package but can be disposed of by the recipient once the package has been opened and the shipped article removed. Furthermore, such a desired packaging material must be relatively inexpensive to manufacture as compared to foam or foam-like compositions.

SUMMARY OF THE INVENTION

Accordingly, the above problems and difficulties are obviated by the present invention which provides a novel packaging material comprised of an inflated cell defined between opposing surfaces of plastic-like material sheets that are joined about their peripheral edges in a sealed manner. Such a cell may be manufactured at the site of use by a machine which outputs the cells in a serial fashion in a strip with means for detaching adjacent ones of the cells from each other at the selection of the user, depending on his shipping requirement. Such a machine includes a tubular source of plastic material that is fed to a machine timed so that multiple stations will effect initially sealing one end of the tube followed by sealing the tube at spaced intervals along its length to define a plurality of cells which are subsequently inflated, and additional means for providing a detachment or separation means between adjacent ones of the cells so that upon discharge, the strip may be separated into one, two, three or more inflated cells at the selection of the user. In one form of the invention, the sealing means may be a heat treatment process while the detachable or separation means may take the form of perforations or a slit provided between adjacent ends of the respective inflated cells.

Therefore, it is among the primary objects of the present invention to provide a novel packaging material which is an inflated cell that may be referred to as a "pillow" and which may be combined with other separate cells to form a shock-absorbing and stuffing material to be carried in cartons or shipping containers about an object to be transported.

Another object of the present invention is to provide a novel packaging material that may be readily produced at the site of shipping and which may comprise one or more air-filled pockets or cells in a strip for use in the shipping process.

Another object of the present invention is to provide a novel machine for producing a series of air-filled pockets or cells in a strip so that the user may dispense as many cells as required for shipping purposes.

Still a further object of the present invention is to provide a novel machine for producing a package material that is produced from a continuous tube that is initially sealed to enclose air, followed by dividing the air-filled tube into a plurality of inflated cells in an end-to-end relationship and which includes means for cutting a detachable slit or perforations into the sealed portion of the tubing between adjacent cells so that the user may readily select the number of air-filled pockets or cells he may need for a shipping purpose.

Another object relates to the disposal of the inventive pockets or cells that permits ready deflation and destruction of used material for environmental purposes such as recycling.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
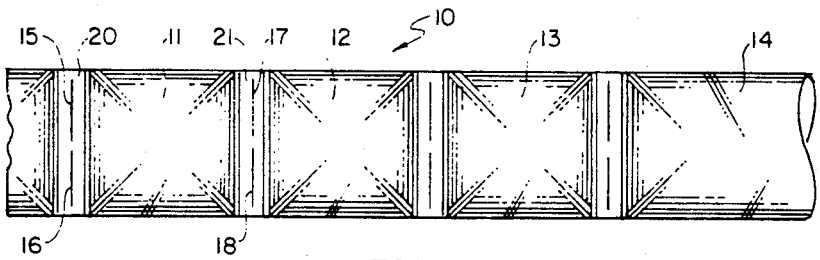
FIG. 1 is a top plan view of a strip of air-filled pockets or cells constituting the package material incorporating the present invention.

Referring to FIG. 1, the novel package material of the present invention is shown in the general direction of arrow 10, which includes a plurality of air-filled cells or pockets, such as represented by numerals 11, 12, 13 and 14, which are arranged serially in an end-to-end relationship in the form of a strip. Any one of a number of pockets or cells may be removed from the strip by means of a detachment means taking the form of a pair of slits 15 and 16 arranged at one end of cell or pocket 11 and slits 17 and 18 arranged at the other end of cell or pocket 11 adjacent to cell or pocket 12. The detachment means is provided in a seal portion or segment 20 located on one side of the cell 11 and a seal segment or portion 21 on the opposite side. The seal between adjacent ones of the cells may be provided by heat-sealing techniques while the slits may be provided by cutters during the fabrication process of the strip itself (to be described later). The package material is preferably composed of a polyethylene material supplied in tubular form from a roll and the composition of the material is preferred because such material will be accepted for recycling purposes whereas polyurethane foam will not.

Figure 2:
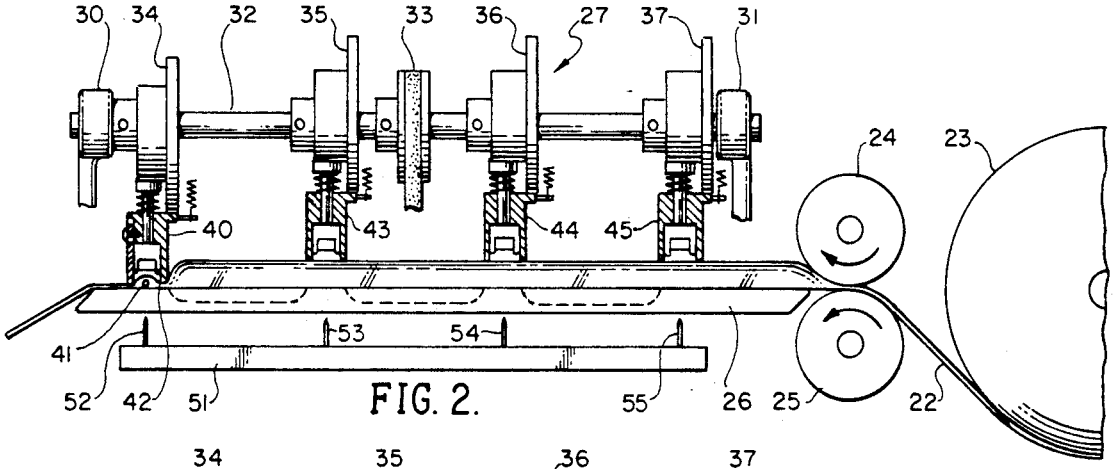
FIG. 2 is a diagrammatic view of a machine for producing the package material in FIG. 1 illustrating the initial step of filling a tube with air.
Figure 3:
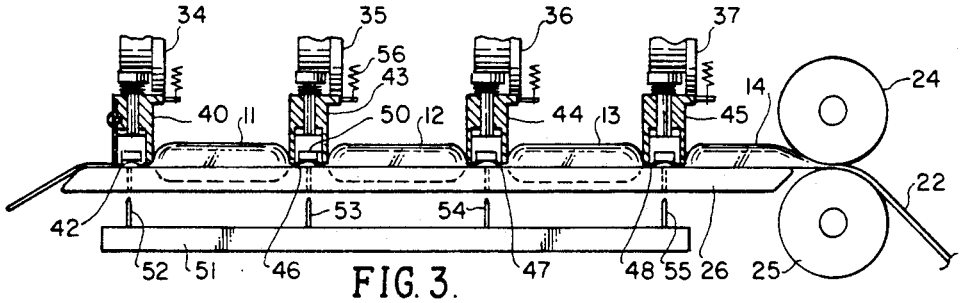
FIG. 3 is a view similar to the view of FIG. 2 illustrating additional means for sealing the tubing into a plurality of individual air-filled pockets or cells.
Figure 4:
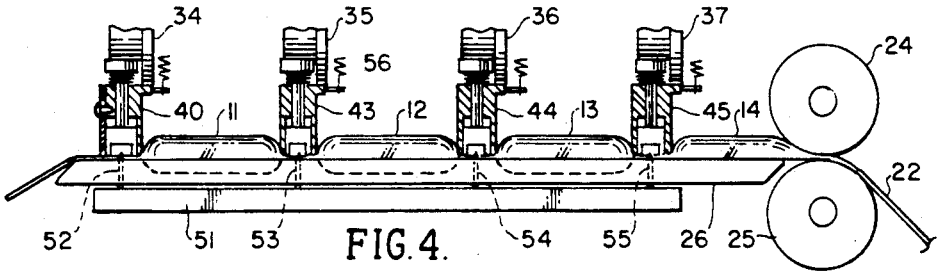
FIG. 4 is a view similar to the views of FIGS. 2 and 3 illustrating means for providing a detachable slit or perforation between adjacent ones of the air-filled pockets or cells preparatory for discharge from the machine.
Figure 5:
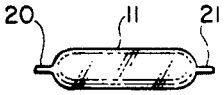
FIG. 5 is a side elevational view of a single inflated cell or "pillow" after separation from a strip.

Referring now to FIGS. 2, 3 and 4, it can be seen that the polyethylene tubing is represented by numeral 22 and that the tubing is supplied from a reel 23 via a pair of drive rollers 24 and 25 which are in counterrotating relationship with the thickness of the tubing 22 being driven from the reel. The tubing is disposed between the peripheral rim of the drive wheels 24 and 25 and is transferred onto a platform 26 so that the tubing rests beneath a plurality of fabricating stations represented by processing equipment within the machine. The machine may be broadly illustrated in the direction of arrow 27. The machine 27 includes fixed stanchions 30 and 31 on opposite ends of the machine which support a rotatable shaft 32 by means of bearings contained within the fixtures. The shaft is rotated by means of a motor (not shown) via a drive belt 33 and timing for providing the various steps in the procedure is effected by cams mounted on the shaft 32. For example, cam 34 is associated with the first station while cams 35, 36 and 37 are associated with stations 2, 3 and 4 respectively.

Initially, the tubing 22 is fed onto the platform 26 where the one end of the tubing is closed by the squeezing of the tube by rollers 24 and 25, while the opposite end of the tube is closed at station number 1 when cam 34 forces U-shaped fixture 40 into engagement with the tubing and forcing the tubing against the surface of the platform 26. It can be seen that the cam 34 engages the top of the U-shaped fixture 40 so that it urges the fixture downwardly into the engagement just described. The cam 34 is eccentrically carried on shaft 32 so that this step will proceed the following steps which include injection of air into the tubing on the platform 26 via an injection 41 which pokes through the material so that pressurized air will inflate the tubing preparatory for the next step. Upon the complete lowering of fixture 40 against the tubing, a segment or portion indicated by numeral 42 is defined between the legs of the U-shaped fixture that is flat and will not be inflated, particularly after the injection mechanism is removed at the end of the pressurization step.

Referring now in detail to FIG. 3, wherein it can be seen that not only is fixture 40 in its initial lowered position against the tubing, but rotation of shaft 32 brings cams 35, 36 and 37 into contact with similar fixtures identified by numerals 43, 44 and 45 respectively. These U-shaped fixtures separate the tubing into individual cells or pockets 11, 12, 13 and 14. The cells or pockets are now inflated with air and are pressurized as described with respect to the procedure in FIG. 2. The U-shaped fixtures further define separation segments between adjacent ones of the cells similar to the segment or portion 42. These latter segments or portions are indicated by numerals 46, 47 and 48 respectively. It is to be understood that these portions are similar to the segments or portions 20 and 21 shown in FIG. 1. FIG. 3 further illustrates that once the U-shaped fixtures have been lowered so as to bear against the tubing and the platform 26, heater elements are then brought into contact with the separating sections or portions to form a seal between the opposite sheets of the tubing. A typical heater is indicated by numeral 50 carried between the opposite legs of the U-shaped fixture 43. The heater is turned on momentarily to effect a heat seal between adjacent ones of inflated cells or pockets.

With respect to FIG. 4, means are shown for providing a detachable means for separating adjacent ones of the cells or pockets. In one form of the invention, a cutting carrier 51 carries a plurality of cutters, such as may be fabricated from a steel rule dye and the cutters are arranged perpendicular to the carrier 51, such as illustrated by the numerals 52, 53, 54 and 55. It can be seen that these cutters are moved so that the cutting edge will pass through the flat, non-inflated segments or portions between adjacent ones of the inflated cells or pockets. Such cutters may provide either perforations or elongated slits, such as shown in FIG. 1 by numerals 15–18 inclusive. Upon the lowering of the cutter carrier 51, the cutters 52–55 inclusive are removed from the tubing and the respective U-shaped fixtures 40, 43, 44 and 45 are raised as the cams are further rotated by shaft 32 so that springs, such as spring 56 associated with fixture 43, will cause the fixtures to raise out of contact with the tubing. At this time, the strip of formed pockets in the tubing may be pulled off of the platform 26 and an additional process may be commenced on a further length of the tubing.

Whenever it is desired for the user or packager to use the cells for shipping purposes, he may either separate a plurality of inflated cells from the strip or he may separate each cell individually by tearing across the slits provided on the flattened and heat-sealed segments or portions between adjacent ones of the cells. In this manner, the machine may be located at the site of shipping and the user need only press a button to turn the machine on so that a selective amount of cells may be discharged or dispensed from the machine at the will of the user.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A machine for producing inflatable packaging cells in an elongated strip comprising:

A source of tubular plastic material;

a processing mechanism for receiving said tubular plastic material and having multiple work stations to perform work on said tubular plastic material;

each work station having a means for holding a selected portion of said tubular plastic material, means for inflating said tubular plastic material between said selected portions, means for sealing said selected portions and means for providing detachment means on said selected portions;

said work station means includes a U-shaped member having spaced-apart leg members for releasably engaging said selected tubular portion;

heater means carried on said U-shaped member for sealing said sealed portion;

cam means engageable with each of said U-shaped members to time sequence actuation of said aforementioned means;

biasing means connected to each of said U-shaped members for disengaging said U-shaped members from said tubular plastic member; and a cutting means having a plurality of cutter blades selectively engageable with said sealed portions.

* * * * *